US006500592B2

(12) United States Patent
Sugai

(10) Patent No.: US 6,500,592 B2
(45) Date of Patent: Dec. 31, 2002

(54) ELECTROPHOTOSENSITIVE MATERIAL

(75) Inventor: Fumio Sugai, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/986,365

(22) Filed: Nov. 8, 2001

(65) Prior Publication Data

US 2002/0086227 A1 Jul. 4, 2002

(30) Foreign Application Priority Data

Nov. 10, 2000 (JP) ..... 2000-342728

(51) Int. Cl.[7] ..... G03G 5/047; G03G 5/06
(52) U.S. Cl. ..... 430/58.25; 430/72; 430/56
(58) Field of Search ..... 430/74, 58.25, 430/56, 72

(56) References Cited

U.S. PATENT DOCUMENTS 5,176,976 A * 1/1993 Kikuchi et al. ..... 430/58.25
5,718,997 A * 2/1998 Hayata et al. ..... 430/58.25

FOREIGN PATENT DOCUMENTS

| | | |
|---|---|---|
| JP | 1-206349 | 8/1989 |
| JP | 7-261419 | 10/1995 |
| JP | 9-151157 | 6/1997 |

OTHER PUBLICATIONS

Tetrahedron Letters, vol. 24, No. 34, pp. 3567–3570 (1983).*

Dong–Sook Choi, et al., "Revised Structures of N–Substituted Dibrominated Pyrrole Derivatives and Their Polymeric Products. Termaleimide Models with Low Optical Band Gaps," J. Org. Chem., vol. 63, No. 8, 1998, pp. 2646–2655.

* cited by examiner

*Primary Examiner*—Christopher Rodee
(74) *Attorney, Agent, or Firm*—Smith, Gambrell & Russell, LLP

(57) ABSTRACT

Disclosed is an electrophotosensitive material comprising a conductive substrate and a photosensitive layer formed on the substrate, the photosensitive layer containing a quinone derivative of the formula (1) and/or (2):

(1)

(2)

($R^1$, $R^2$, $R^6$ and $R^7$ are alkyl; $R^3$ and $R^8$ are alkyl, alkoxy, aryl, aralkyl, hydrogen or atom; $R^4$ and $R^5$ are alkyl, alkoxy, aryl, aralkyl, hydrogen or halogen, or form a ring by binding each other; X is halogen; m is 1 to 4, n and p are 1 to 4.) The photosensitive material has high sensitivity.

7 Claims, 2 Drawing Sheets

ELECTROPHOTOSENSITIVE MATERIAL

BACKGROUND OF THE INVENTION

The present invention relates to an electrophotosensitive material containing a quinone derivative having an excellent electric charge transferability, which is used in image forming apparatuses such as electrostatic copying machine, facsimile and laser beam printer.

In the image forming apparatuses, a so-called organic photosensitive material has widely been used, which comprises an electric charge generating material generating an electric charge under light radiation, an electric charge transferring material transferring thus generated electric charge and a binder resin constituting a layer in which the above substances are dispersed.

The organic photosensitive material is divided into tow main classes of a single-layer type photosensitive material wherein an electric charge generating material and an electric charge transferring material are dispersed in the same photosensitive layer and a multi-layer type photosensitive material having a laminated structure of an electric charge generating layer containing an electric charge generating material and an electric charge transferring layer containing an electric charge transferring material. Further, in the multi-layer type photosensitive material, the electric charge transferring layer having a film thickness larger than that of the charge generating layer is deposited at the outermost layer of the photosensitive material in view of the mechanical strength.

The electric charge transferring material used in these photosensitive materials includes a hole transferability type one and an electron transferability type one, and among the electric charge transferring materials known until now almost all of electric charge transferring materials having high carrier mobility so as to provide practically useful sensitivity with the photosensitive material have hole transferability. Therefore, in the organic photosensitive material which is now put into practical use, the multi-layer type photosensitive material comprises the electric charge transferring layer at the outermost layer becomes a negatively charging type one inevitably.

However, this negatively charging type organic photosensitive material must be charged by negative corona charge accompanied with the generation of a large amount of ozone, thereby to cause problems such as influence on the environment and deterioration of the photosensitive material itself.

To solve the problems described above, it has been studied to use an electron transferring material as the electric charge transferring material.

Japanese Published Unexamined Patent Application (Kokai Tokkyo Koho Hei) No. 1-206349 suggests to use, as the electron transferring material, a compound having a structure of diphenoquinone or benzoquinone.

However, a compound having diphenoquinone structure or benzoquinone structure is poor in matching with the electric charge generating material and insufficient in injection of electrons into the electron transferring material from the electric charge generating material. Since such an electron transferring material has low compatibility with a binder resin and is not uniformly dispersed in a photosensitive layer, the hopping distance of electrons becomes longer and electrons are less likely to move at low electric field.

Accordingly, as is apparent from electrical characteristics test described in Examples described hereinafter, the above-described conventional photosensitive material containing an electron transferring material had problems such as high residual potential and poor sensitivity.

The single-layer photosensitive material has advantages that one photosensitive material can be used in both of positively and negatively charging type apparatuses by using electron and hole transferring materials in combination. However, there arise problems that, when using diphenoquinone derivative as the electron transferring material, a charge transfer complex is formed by an interaction between the electron and hole transferring materials, thereby inhibiting transfer of electrons and holes.

To solve the problems described above, Japanese Published Unexamined Patent Application (Kokai Tokkyo Koho Hei) Nos.7-261419 and 9-151157 disclose to use a naphtoquinone derivative as the electron transferring material.

However, even when using a naphthoquinone derivative as the electron transferring material, it is not sufficient in matching with the electron generating material and in compatibility with a binder resin.

SUMMARY OF THE INVENTION

Thus, an object of the present invention is to solve the technical problems described above and to provide an electrophotosensitive material whose sensitivity has been improved as compared with a conventional one.

While studying intensively to solve the problems described above, the present inventors have found a new fact that: a quinone derivative represented by the general formula (1):

(1)

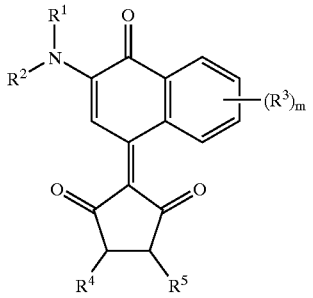

wherein $R^1$ and $R^2$ are the same or different and represent an alkyl group, $R^3$ represents an alkyl group, an alkoxy group, an aryl group, an aralkyl group, a hydrogen atom or a halogen atom, $R^4$ and $R^5$ are the same or different and represent an alkyl group, an alkoxy group, an aryl group, an aralkyl group, a hydrogen atom or a halogen atom, or form a ring by binding each other, and m represents an integer of 1 to 4, and/or, a quinone derivative represented by the general formula (2):

(2)

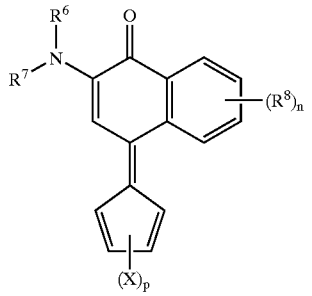

wherein $R^6$ and $R^7$ are the same or different and represent an alkyl group, $R^8$ represents an alkyl group, an alkoxy group, an aryl group, an aralkyl group, a hydrogen atom or a halogen atom, X represents a halogen atom, and n and p represent an integer of 1 to 4, have higher electron transferability as compared with a conventional electron transferring material such as a compound having diphenoquinone structure or benzoquinone structure and an excellent compatibility with a binder resin. Quinone derivatives of the general formulas (1) and (2) are known compounds described in Tetrahedron Letters, Vol.24, No.34, pp3567–3570, 1983.

Thus, the present invention includes the following inventions.

1) An electrophotosensitive material comprising a conductive substrate and a photosensitive layer formed on the conductive substrate, the photosensitive layer containing a quinone derivative represented by the general formula (1) and/or a quinone derivative represented by the general formula (2).

2) The electrophotosensitive material according to the above item 1), wherein said photosensitive layer contains an electron acceptor.

3) The electrophotosensitive material according to the above item 1), wherein said photosensitive layer is a single layer constituent containing a binder resin, an electric charge generating material and a quinone derivative represented by the general formula (1) and/or a quinone derivative represented by the general formula (2) as an electron transferring material.

4) The electrophotosensitive material according to the above item 1), wherein said photosensitive layer is a multi layer constituent comprising an electric charge generating layer containing an electric charge generating material and an electric charge transferring layer containing a binder resin and a quinone derivative represented by the general formula (1) and/or a quinone derivative represented by the general formula (2) as an electron transferring material.

Quinone derivatives represented by the general formulas (1) and (2) [hereinafter, sometimes referred to as quinone derivative (1) and quinone derivative (2), and "quinone derivatives" is used as representing both (1) and (2).] have an excellent electron acceptability and further good compatibility with a binder resin, thereby making it possible to uniformly disperse in the binder resin. Furthermore, quinone derivatives (1) and (2) are superior in matching with the electric charge generating material and injection of electrons from the electric charge generating material is smoothly conducted. Accordingly, quinone derivatives (1) and (2) exhibit excellent electric charge transferability even at low electric field and are suited for use as the electron transferring material in the electrophotosensitive material.

Moreover, since quinone derivatives (1) and (2) do not form a charge transfer complex with the hole transferring material, they are used particularly preferably in the single-layer type photosensitive layer using the electron transferring material in combination with the hole transferring material.

The electrophotosensitive material of the present invention is characterized in that the photosensitive layer is formed on the conductive substrate and said photosensitive layer contains quinone derivative (1) and/or quinone derivative (2).

Since such electrophotosensitive material contains quinone derivative (1) and/or quinine derivative (2) which have excellent properties as described above in the photosensitive layer, the residual potential is lower and the sensitivity is higher as compared with those of the electrophotosensitive material containing conventional electron transferring material.

Thus, the photosensitive layer containing quinone derivative (1) and/or quinone derivative (2) is superior in electron transferability at low electric field and less likely to cause recombination ratio of electrons and holes in the photosensitive, whereby apparent electric charge generation efficiency approaches an actual value. As a result, the sensitivity of the photosensitive material containing such photosensitive layer is improved. The residual potential of the photosensitive material is also lowered, thereby improving the stability and durability on repeated exposure.

Accordingly, a positively charged type photosensitive material having a higer senisitivity as compared with conventional one can be obtained by using quinone derivative (1) and/or quinone derivative (2) as an electric charge generating material which is contained in an electric charge transferring layer of multi-layer type photosensitive material or as an electron transferring material which is contained in an photosensitive layer of single-layer type photosensitive material.

Since quinone derivatives (1) and (2) do not form a charge transfer complex with the hole transferring material as described above, a photosensitive material having higher sensitivity can be obtained when using them in a single-layer type photosensitive material containing the electron transferring material and hole transferring material in the same photosensitive layer.

In the electrophotosensitive material of single-layer type, quinone derivative (1) and /or quinone derivative is usually incorporated in the amount within from 5 to 500 parts by weight, preferably from 10 to 500 parts by weight, and more preferably from 10 to 80 parts by weight, based on 100 parts by weight of the binder resin.

In case that quinone derivatives (1) and/or (2) is in the amount of less than 5 parts by weight, the residual potential becomes higher thereby it is feared that the sensitivity becomes insufficient; in case the amount of more than 500 parts by weight, thereby making quinone derivatives (1) and/or (2) possible to crystallize and the electrophotosensitive material does not sufficiently exhibit its function.

In the electrophotosensitive material of the multi-layer type, it comprises an electric charge generating layer containing an electric charge generating material and an resin binder and a electric charge transferring layer containing quinone derivatives (1) and/or (2). In the multi-layer type one, quinone derivatives (1) and/or (2) is preferably incorporated in the amount within a range from 10 to 500 parts by weight, and more preferably from 25 to 100 parts by weight, according to the same reason in the single-layer type one.

Moreover, in case that an electric acceptor is incorporated in said photo sensitive layer, since the electron transferability is improved much further, the photosensitive material having higher sensitivity can be obtained.

DETAILED DESCRIPTION OF THE INVENTION

Figure 1:
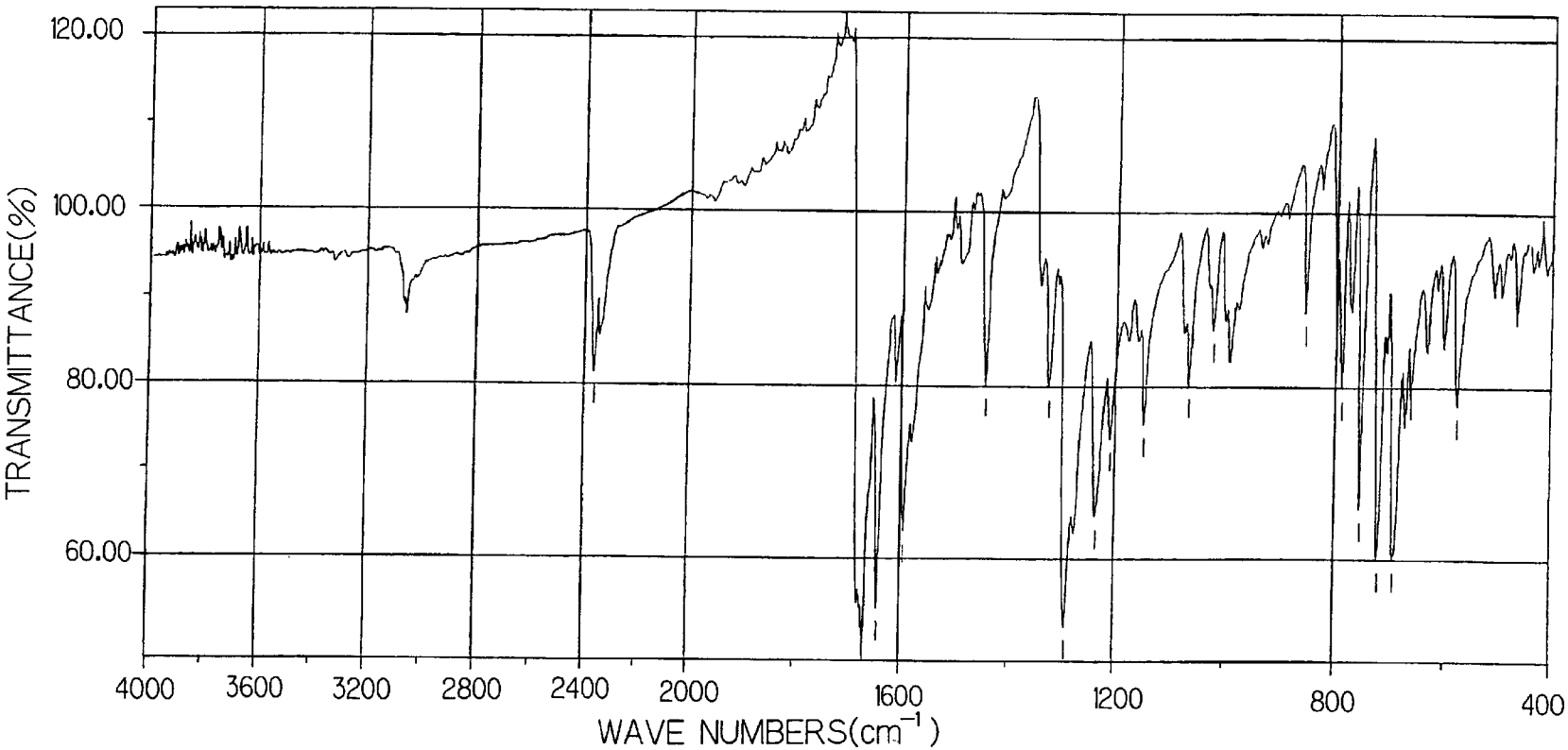
FIG. 1 shows infrared absorption spectrum of the quinone derivative (1-8).

The present invention is explained in detail as follows:

Quinone Derivatives (1) and (2)

In the general formulas (1) and (2), examples of the alkyl group corresponding to the substituents $R^1$ to $R^8$ include methyl, ethyl, n-propyl, isopropyl, n-butyl, isobutyl, s-butyl, t-butyl, n-pentyl, isopentyl, neopentyl and hekxyl groups having 1 to 6 carbon atoms. Among them, preferable examples include the alkyl group having 1 to 4 carbon atoms such as methyl, ethyl, n-propyl, isopropyl, n-butyl, isobutyl, s-butyl or t-butyl.

Examples of the alkoxy group corresponding to the substituents $R^3$ to $R^5$ and $R^8$ include methoxy, ethoxy, propoxy, isopropoxy, butoxy, t-butoxy, pentyloxy or hexyloxy grous having 1 to 6 carbon atoms.

Examples of the aryl group include phenyl, tolyl, xylyl, biphenylyl, o-terphenyl, naphthyl, anthryl, phenanthryl groups having 6 to 14 carbon atoms.

Examples of the aralkyl group include benzyl, 1-phenylethyl, 3-phenylpropyl, 4-phenylbutyl, 5-phenylpentyl, 6-phenylhexyl, benzhydryl, trityl or phenethyl groups having 6 to 14 carbon atoms.

The alkyl groups corresponding to $R^1$ to $R^8$, and the alkoxy groups, aryl group and aralkyl group corresponding to $R^3$ to $R^5$ and $R^8$ may be substituted, examples of substituted groups include hydroxyalkyl group, alkoxyalkyl group, monoalkylaminoalkyl group, dialkylaminoalkyl group, halogen-substituted alkyl group, alkoxycarbonylalkyl group, carboxyalkyl group, alkanoyloxyalkylgroup, aminoalkyl group,_halogen atom, amino group, hydroxy group, carboxy group optionally esterified or cyano group and so on, or the avobe-mentioned alkyl groups having 1 to 6 carbon atoms which may be substituted, or the above-mentioned alkoxy group having 1 to 6 carbon atoms which may be substituted. These substituents are not restricted with regard to substitution positions.

Examples of halogen atom corresponding to X include fluorine, chlorine, bromine or iodine.

Examples of quinone derivative include compounds represented by the following formulas (1-1) to (1-16) as quinone derivative (1).

(1-1)

The compound of the formula (1-1):

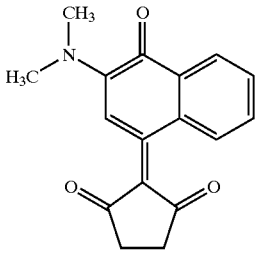

-continued (1-2)

The compound of the formula (1-2):

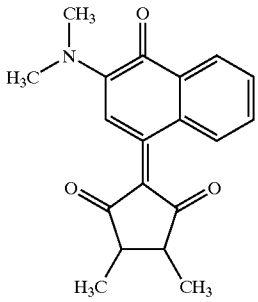

(1-3)

The compound of the formula (1-3):

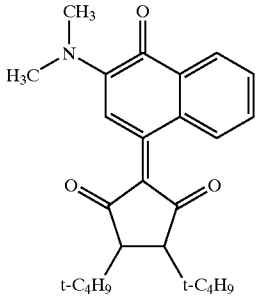

(1-4)

The compound of the formula (1-4):

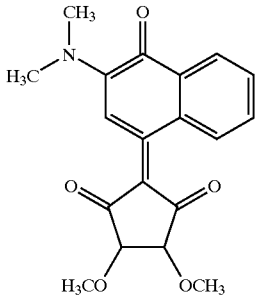

(1-5)

The compound of the formula (1-5):

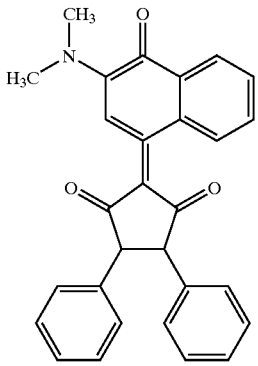

-continued
(1-6)
The compound of the formula (1-6):
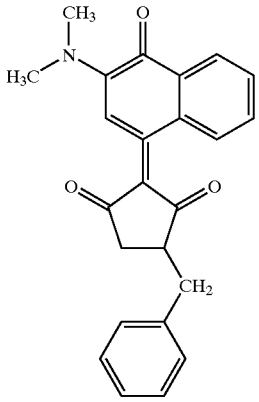
(1-7)
The compound of the formula (1-7):
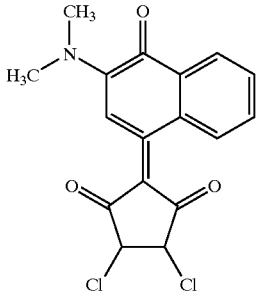
(1-8)
The compound of the formula (1-8):
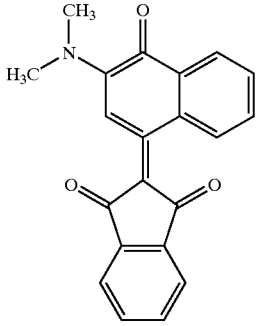
(1-9)
The compound of the formula (1-9):
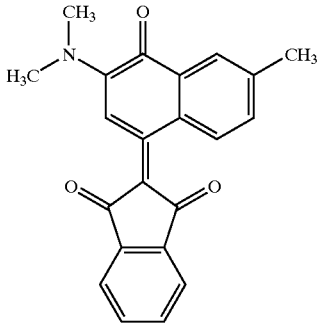
-continued
(1-10)
The compound of the formula (1-10):
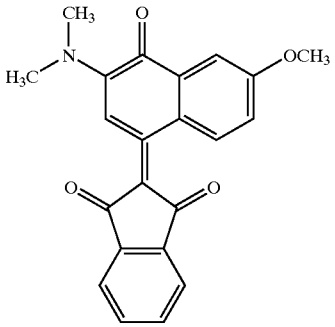
(1-11)
The compound of the formula (1-11):
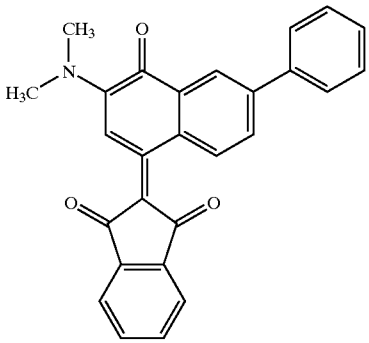
(1-12)
The compound of the formula (1-12):
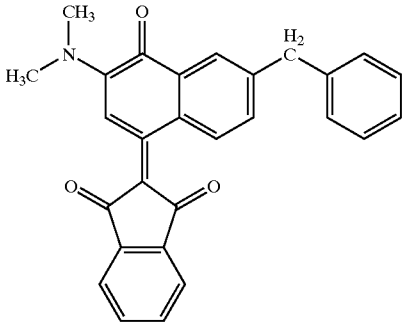
(1-13)
The compound of the formula (1-13):
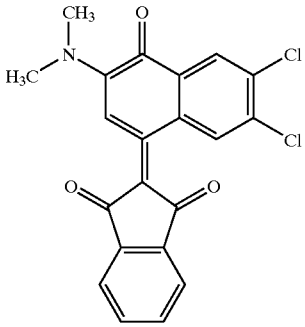

-continued (1-14)

The compound of the formula (1-14):

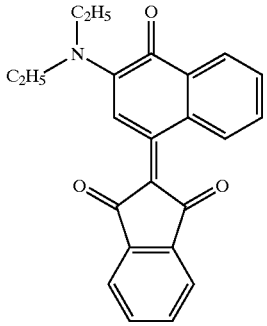

(1-15)

The compound of the formula (1-15):

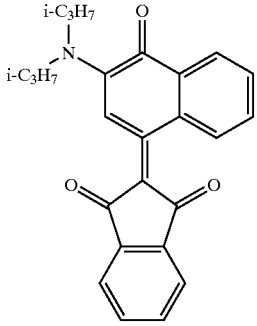

(1-16)

The compound of the formula (1-16):

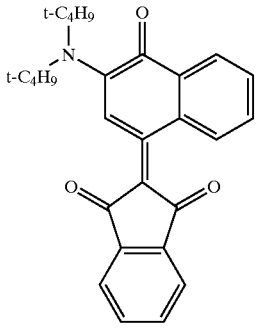

Further, examples of quinone derivative include compounds represented by the following formulas (2-1) to (2-12) as quinone derivative (2).

(2-1)

The compound of the formula (2-1):

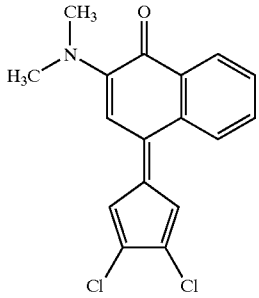

-continued (2-2)

The compound of the formula (2-2):

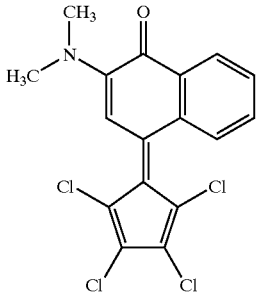

(2-3)

The compound of the formula (2-3):

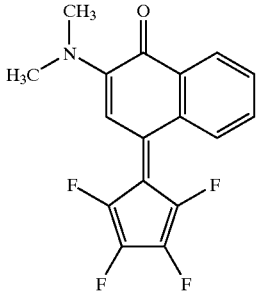

(2-4)

The compound of the formula (2-4):

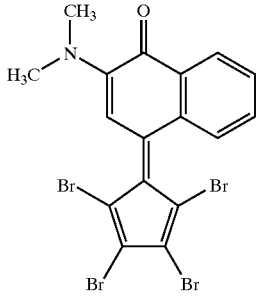

(2-5)

The compound of the formula (2-5):

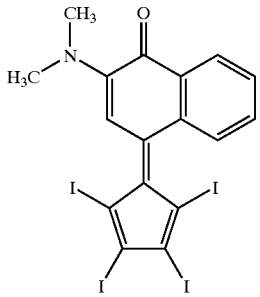

(2-6)

The compound of the formula (2-6):

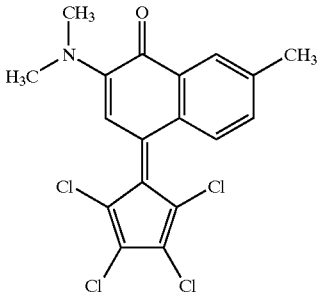

-continued (2-7)

The compound of the formula (2-7):

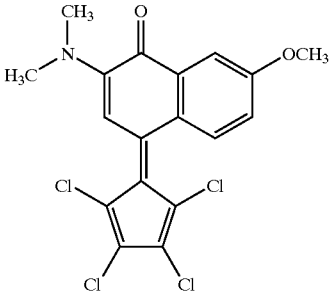

(2-8)

The compound of the formula (2-8):

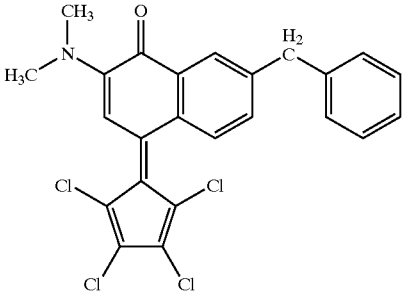

(2-9)

The compound of the formula (2-9):

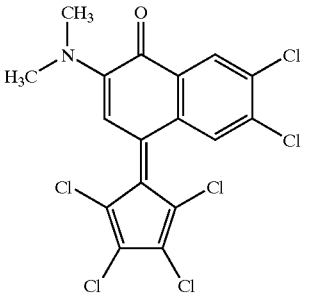

(2-10)

The compound of the formula (2-10):

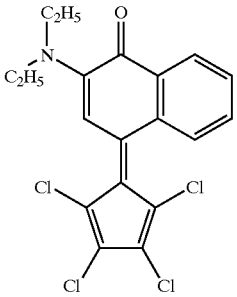

(2-11)

The compound of the formula (2-11):

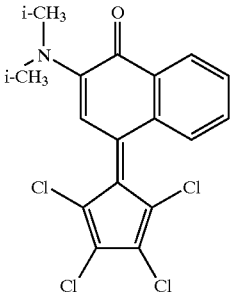

-continued (2-12)

The compound of the formula (2-12):

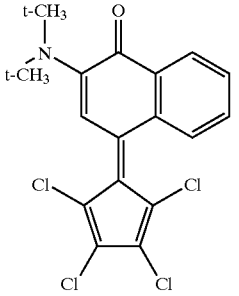

Quinone derivatives described above is incorporated to the photosensitive layer alone or in a combination use of two or more.

Quinone derivatives (1) and (2) can be synthesized according to the method described in Tetrahedron Letters, Vol.24, No.34, pp3567–3570, 1983. Thus, the method comprises: 2-dimethyamino-1,4-naphthoquinone is reacted with triethoxyoxotetrafluoroborate to synthesis an intermediate compound, and the resulting compound is reacted with its corresponding active methylated compound, which may be a cyclic or linear form, in a solvent of pyridine to obtain the desired quinone derivative.

Photosensitive Layer

The electrophotosensitive material of the present invention comprises forming a photosensitive layer, which contains a quinone derivative represented by the general formula (1) and/or (2) as the electron transferring material, on a conductive substrate. The photosensitive layer can be applied to any of the single-layer type and multi-layer type photosensitive materials.

Single-layer Type Photosensitive Material

The single-layer type photosensitive material is produced by forming a single photosensitive layer containing at least quinone derivative (1) and/or (2) as the electron transferring material, an electric charge generating layer and a binder resin on a conductive substrate. Such a single-layer type photosensitive layer can be applied to any of positively and negatively charging type photosensitive materials with a single construction, but is preferably used in the positively charging type photosensitive material which does not require a negative corona charge. This single-layer type photosensitive material has advantages such as easy production due to simple structure, inhibition of film defects on formation of layers, and improvement in optical characteristics due to fewer interfaces between layers.

Regarding the single-layer type photosensitive material using quinone derivative (1) and/or (2) as the electron transferring material in combination with the hole transferring material having excellent hole transferability, since an interaction between quinone derivative (1) or (2) and the hole transferring material does not occurs, the transfer of electrons and that of holes can be efficiently conducted even if both transferring materials are incorporated in the same photosensitive layer. Therefore, a photosensitive material having high sensitivity can be obtained.

Moreover, the single-layer type photosensitive material incorporated an electron acceptor together with quinone derivative (1) and/or (2) is much more improved in the electron transferability, thereby to obtain the photosensitive material having higher sensitivity.

Multi-layer Type Photosensitive Material

The multi-layer type photosensitive material is produced by laminating an electric charge generating layer containing an electric charge generating material and an electric charge transferring layer containing an electric charge transferring material on a conductive substrate in this or reverse order. Since the electric charge generating layer has a very thin film thickness as compared with the electric charge transferring layer, it is preferred that the electric charge generating layer is formed on the conductive substrate and the electric charge transferring layer is formed thereon to protect the electric charge generating layer.

The charging type (positively or negatively charging) of the multi-layer type photosensitive layer is selected depending on the formation order of the electric charge generating layer and electric charge transferring layer and the kinds of the electric charge transferring material used in the electric charge transferring layer. In the layer construction wherein the electric charge generating layer is formed on the conductive substrate and the electric charge transferring layer is formed thereon, when using the electron transferring material such as quinone derivative (1) and/or (2) as the electric charge transferring material in the electric charge transferring layer, a positively charging type photosensitive material is obtained. In this case, a hole transferring material or an electron transferring material may be incorporated in the electric charge transferring layer. Hereto, when incorporating an electron acceptor into said electric charge transferring layer, since the electron transferability is improved, the multi-layer photosensitive material having higher sensitivity can be obtained.

In the layer construction described above, when using the hole transferring material as the electric charge transferring material in the electric charge transferring layer, a negatively charging type photosensitive material is obtained. In this case, when the electric charge generating layer contains quinone derivative (1) and/or (2), the multi-layer type photosensitive material can be obtained in higher sensitivity, since the electrons among the generated electric charges can be efficiently transferred until the conductive substrate.

The electric charge generating material, hole transferring material, electron acceptor and binder resin used in the electrophotosensitive material of the present invention are as follows.

Electric Charge Generating Material

As the electric charge generating material used in the present invention, there can be used, for example, inorganic photoconductive material powders such as selenium, selenium-tellurium, selenium-arsenic, cadmium sulfide or a-silicon, etc.; or various conventionally known pigments such as various phthalocyanine pigment comprising crystals in various crystal forms such as the metal-free phthalocyanine represented by the formula (CG-1):

(CG-1)

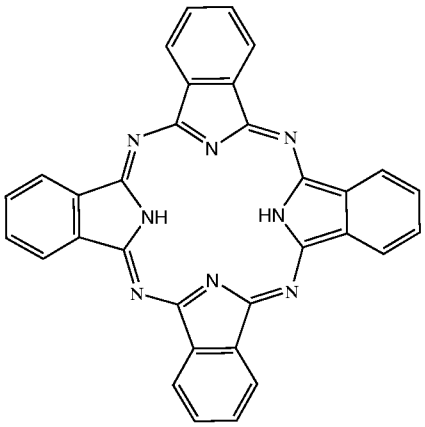

the titanylphthalocyanine represented by the formula (CG-2):

(CG-2)

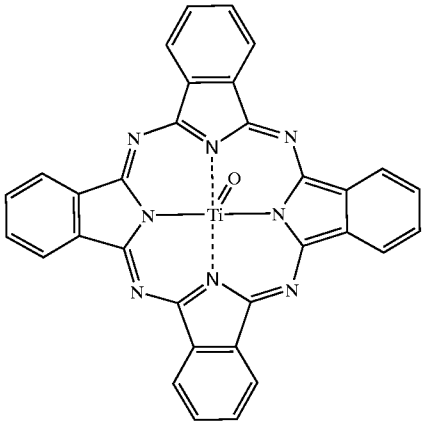

azo pigment, bisazo pigment, perylene pigment, anthanthrone pigment, indigo pigment, triphenylmethane pigment, threne pigment, toluidine pigment, pyrrazoline pigment, quinacridone pigment or dithioketopyroropyrrole, etc. These electric charge generating materials can be used alone or in combination of 2 or more so as to have sensitivity in desired wave length range.

A photosensitive material having the sensitivity within a wavelength range of 700 nm or more is required in digital optical image forming apparatuses using a light source such as semiconductor laser, for example, laser beam printer and facsimile. Therefore, phthalocyanine pigments are preferably used as the electric charge generating material in exemplified above.

Hole Transferring Material

As the hole transferring material used in the present invention, there mentioned various compounds having high hole transferability, for example, oxadiazole compounds [e.g. 2,5-di(4-methylaminophenyl)-1,3,4-oxadiazole], styryl compounds [e.g. 9-(4-diethylaminostyryl)anthracene], carbazole compounds [e.g. poly-N-vinylcarbazole], organopolysilane compounds, pyrazoline compounds [e.g. 1-phenyl-3-(p-dimethylaminophenyl)pyrazoline], hydrazone compounds, triphenylamine compounds, indole compounds, oxazole compounds, isoxazole compounds, thiazole compounds, thiadiazole compounds, imidazole compounds, pyrazole compounds, triazole compounds, stylbene compounds, benzidine compounds, phenylenediamine, naphthylenediamine, phenanethrylenediamine, butadiene compounds, acrolein compounds, thiophene compounds, condensed polycyclic compounds, or polymer compounds such as organic polysilane compounds or polyhhydrazone and so on.

In the present invention, these hole transferring materials can be used alone or in combination of 2 or more. When using the hole transferring material having a film forming property such as polyvinylcarbazole, a binder resin is not required necessarily.

Electron Acceptor

In the electrophotosensitive material of the prsent invention, an electron acceptor may be incorporated in the photosensitive layer together with quinone derivative (1) and/or (2) as an electron transferring material.

As the electron acceptor used in the present invention, there mentioned various electron attractive compounds having high electrontransferability, for example, such as benzoquinone compounds, diphenoquinone compounds, naphtoquinone compounds, malononitrile compounds, thiopyrane compounds, tetracyanoethylene, 2,4,8-trinitrothioxantone, fluorenone compounds such as 2,4,7-trinitro-9-fluorenone, etc., dinitrobenzene, dinitroanthracene, dinitroacridine, nitroanthraquinone, succinic anhydride, maleic anhydride, dibromo maleic anhydride, 2,4,7-trinitrofluorenoneimine compounds, ethyl nitrofluoreneimine compounds, triptoanthrin compounds, azafluorenone compounds, dinitropyridoquinazoline, thioxanthene, 2-phenyl-1,4-benzoquinone compounds, 2-phenyl-1,4-naphthoquinone compounds, 5,12-naphthacenequinone compounds, α-cyanostilbene compounds, 4'-nitrostilbene compounds, or salts made from anion radical originated from benzoquinone compounds and cation, and so on. In the present invention, these electron acceptors can be used alone or in combination of 2 or more.

Binder Resin

The binder resin in which the above respective components are dispersed, there can be used various resins which have hitherto been used in the photosensitive layer. Examples thereof include thermoplastic resins such as styrene-butadiene copolymer, styrene-acrylonitrile copolymer, styrene-maleic acid copolymer, acrylic copolymer, styrene-maleic acid copolymer, acrylic copolymer, styrene-acrylic acid copolymer, polyethylene, ethylene-vinyl acetate copolymer, chlorinated polyethylene, polyvinyl chloride, polypropylene, ionomer, vinyl chloride-vinyl acetate copolymer, polyester, alkyd resin, polyamide, polyurethane, polycarbonate, polyallylate, polysulfone, diallyl phthalate polymer, ketone resin, polyvinyl butyral resin, polyether resin and polyester resin; crosslinkable thermosetting resins such as silicone resin, epoxy resin, phenol resin, urea resin and melamine resin; and photocuring resins such as epoxy acrylate and urethane acrylate. These binder resins can be used alone or in combination of 2 or more.

Other Additives

In addition to the above respective components, conventionally known various additives such as oxidation inhibitors, radical scavengers, singlet quenchers, antioxidants (e.g. ultraviolet absorbers), softeners, plasticizers, surface modifiers, excipients, thickeners, dispersion stabilizers, waxes, acceptors and donors can be incorporated in the photosensitive layer as far as electrophotographic characteristics are not adversely affected. To improve the sensitivity of the photosensitive layer, for example, known sensitizers such as terphenyl, halonaphthoquinones and acenaphthylene may be used in combination with the electric charge generating material.

In the single-layer type photosensitive material, the electric charge material may be incorporated in the amount within a range from 0.1 to 50 parts by weight, and preferably from 0.5 to 30 parts by weight, based on 100 parts by weight of the binder resin. The quinone derivative (electron transferring materials) represented by the general formula (1) and/or (2) is incorporated in the amount within a range from 5 to 500 parts by weight, preferably from 10 to 500 parts by weight, and more preferably from 10 to 80 parts by weight, based on 100 parts by weight of the binder resin.

In case the electron acceptor is incorporated in said photosensitive layer, the electron acceptor is incorporated in the amount within a range from 0.1 to 40 parts by weight, and preferably from 0.5 to 20 parts by weight, based on 100 parts by weight of the binder resin. In case the hole transferring material is incorporated in said photosensitive layer, the hole transferring material is incorporated in the amount within a range from 5 to 500 parts by weight, and preferably from 25 to 200 parts by weight, based on 100 parts by weight of the binder resin. The thickness of the photosensitive layer in the single-layer type photo sensitive material is within a range from 5 to 100 μm, and preferably from 10 to 50 μm.

In the multi-layer type photosensitive material, the electric charge generating material and binder resin, which constitute the electric charge generating layer, can be incorporated in various ratios, but the electric charge generating material may be incorporated in the amount within a range from 5 to 1000 parts by weight, and preferably from 30 to 500 parts by weight, based on 100 parts by weight of the binder resin. When the hole transferring material or the electron acceptor is incorporated in the electric charge generating layer, the hole transferring material or the electron acceptor may be incorporated in the amount within a range from 0.1 to 100 parts by weight, and preferably from 0.5 to 80 parts by weight, based on 100 parts by weight of the binder resin.

The electron transferring material and binder resin, which constitute the electric charge transferring layer, can be incorporated in various ratios as far as the transfer of the electric charges is not adversely affected and crystallization does not occur. Quinone derivative (1) and/or (2)as the electron transferring material is preferably incorporated in the amount within a range from 10 to 500 parts by weight, and particularly from 25 to 100 parts by weight, based on 100 parts by weight of the binder resin, so that the electric charges generated by light irradiation in the electric charge generating layer can be transferred easily. In case the electron acceptor is incorporated in the electric charge transferring layer, the electron acceptor may be incorporated in the amount within a range from 0.1 to 40 parts by weight, and preferably from 0.5 to 20 parts by weight, based on 100 parts by weight of the binder resin. When the hole transferring material is incorporated in the electric charge transferring layer, the hole transferring material may be incorporated in the amount within a range from 5 to 200 parts by weight, and preferably from 10 to 80 parts by weight, based on 100 parts by weight of the binder resin.

With respect to ratio of quinone derivative described above, the amount means the respective amount when quinone derivative (1) or quinone derivative (2) is incorporated alone, and means the total amount when quinone derivative (1) and quinone derivative(2) are incorporated in a combination use.

A barrier layer may be formed between the conductive substrate and photosensitive layer in the single-layer type photosensitive material, whereas, in the multi-layer type photosensitive material, the barrier layer may be formed between the conductive substrate and electric charge generating layer, or between the conductive substrate and electric charge transferring layer, or between the electric charge generating layer and electric charge transferring layer, as far as characteristics of the photosensitive material are not adversely affected. A protective layer may be formed on the surface of the photosensitive material.

Conductive Substrate

As the conductive substrate on which the photosensitive layer is formed, for example, various materials having the conductivity can be used. The substrate includes, for example, conductive substrates made of metallic simple substances such as iron, aluminum, copper, tin, platinum, silver, vanadium, molybdenum, chromium, cadmium, titanium, nickel, palladium, indium, stainless steel and brass; substrates made of plastic materials prepared by depositing or laminating the above metals; and substrates made of glasses coated with aluminum iodide, tin oxide and indium oxide.

The conductive substrate may be in the form of a sheet or drum according to the structure of the image forming apparatus to be used. The substrate itself may have the conductivity, or the surface of the substrate may have the conductivity. The conductive substrate may be preferably those having a sufficient mechanical strength on use.

Production Method

When the photosensitive layer is formed by the coating method, a dispersion is prepared by dispersing and mixing the above electric charge generating material, electric charge transferring material and binder resin, together with a proper solvent, using a known method such as roll mill, ball mill, attritor, paint shaker, and ultrasonic dispersing equipment to prepare a dispersion, and then the resulting dispersion is coated by using a known means and dried.

As the solvent for preparing the dispersion, various organic solvents can be used. Examples thereof include alcohols such as methanol, ethanol, isopropanol and butanol; aliphatic hydrocarbons such as n-hexane, octane and cyclohexane; aromatic hydrocarbons such as benzene, toluene and xylene; halogenated hydrocarbons such as dichloromethane, dichloroethane, chloroform, carbon tetrachloride and chlorobenzene; ethers such as dimethyl ether, diethyl ether, tetrahydrofuran, ethylene glycol dimethyl ether and diethylene glycol dimethyl ether; ketones such as acetone, methyl ethyl ketone and cyclohexanone; esters such as ethyl acetate and methyl acetate; and dimethylformaldehyde, dimethylformamide and dimethyl sulfoxide. These solvents can be used alone, or two or more kinds of them can be used in combination.

To improve the dispersion properties of the electric charge transferring material and electric charge generating material, and the smoothness of the surface of the photosensitive layer, for example, surfactants and leveling agents may be added.

EXAMPLES

The following Synthesis Examples, Examples and Comparative Examples further illustrate the present invention in detail.

[Synthesis of Quinone Derivative]

Synthesis Example 1

2-diethylamino-1,4-naphthoquinone (2.3 g, 0.01 mol) was added in a two-necked flask to replace with argon, and then dichloromethane solution (50 mL) and triethoxyoxonium tetrafluorobprate (30 mL, 0.02 mol) were added at room temperature, further dichloromethane (20 mL) was added there, and heated under reflux for 30 minutes. After cooling at room temperature, 1,3-indanedione(1.75 g, 0.012 mol)/pyridine 100 mL was added and then heated under reflux for 3 hours. The reaction mixture was cooled, the separated solid was filtered out, and the resulting solid was washed with diluted aqueous hydrochloric acid and distilled water. The solid was dissolved in chloroform, the organic layer was dried under anhydrous magnesium sulfate, the organic solvent was distilled off under reduced pressure and purified by a column chlomatography to obtain 1.2 g (yield 35%) of a quinone derivative (thereafter, referred to as the quinone derivative (1-8)) represented by the above-described formula (1-8). FIG. 1 shows the infrared absorption spectrum of the quinone derivative (1-8).

Synthesis Example 2

Figure 2:
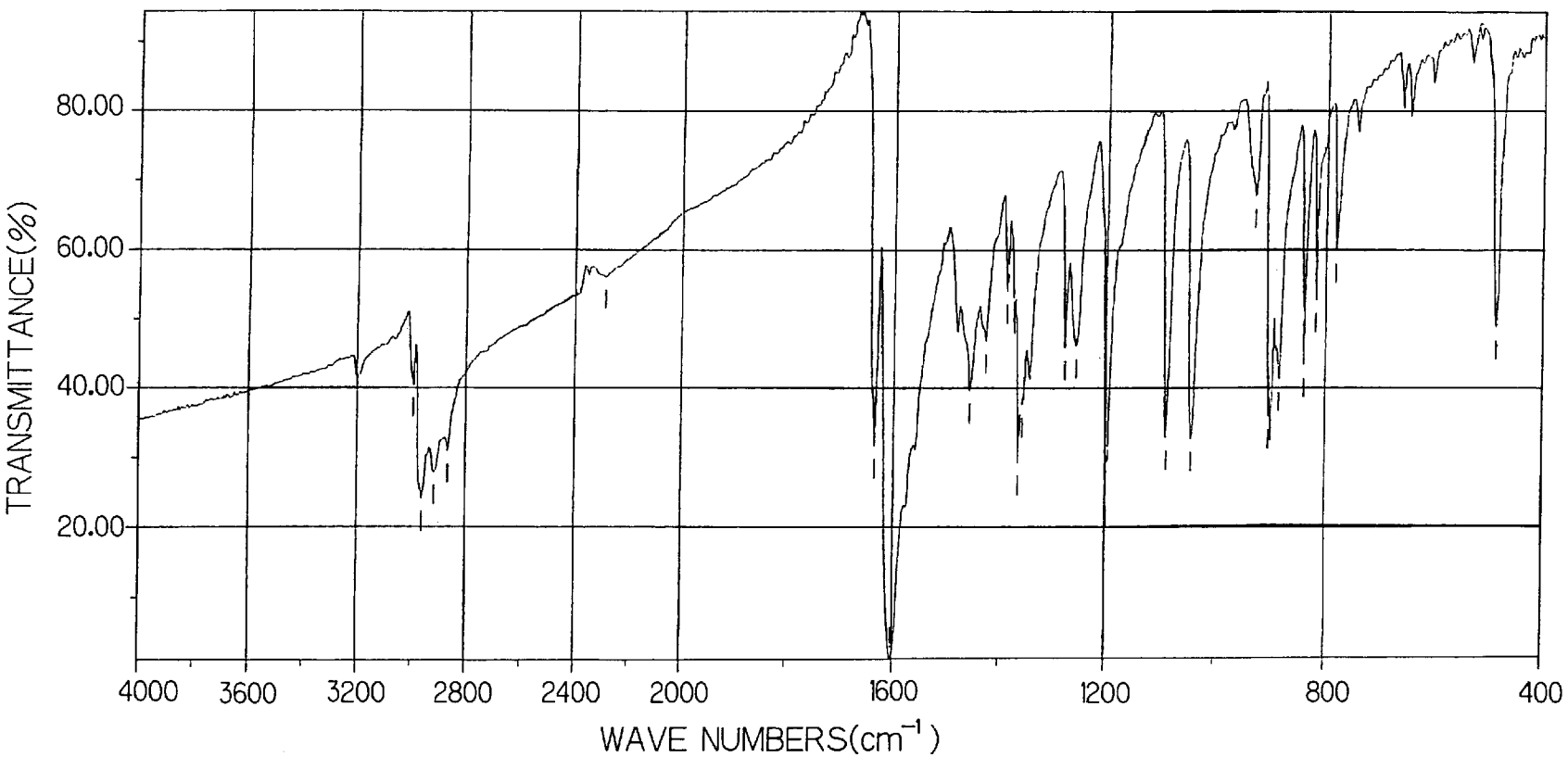
FIG. 2 shows infrared absorption spectrum of the quinone derivative (2-2).

The same manner as in of Synthesis Example 1, except that tetrachlorocyclopentanedien (2.45 g, 0.012 mol) in replace of 1,3-indanedione was used, was conducted to obtain 1.0 g (yield 25%) of the quinone derivative (2-2) (thereafter, referred to as the quinone derivative (2-2)) represented by the above-described formula (2-2). FIG. 2 shows the infrared absorption spectrum of the quinone derivative (2-2).

Production of Electrophotosensitive Material

Single-layer Type Photosensitive Material

Example 1

Five parts by weight of an X type metal-free phthalocyanine (CG-1) as the electric charge generating material, 100 parts by weight of polycarbonate as the binder resin, 800 parts by weight of tetrahydrofuran as the solvent, 50 parts by weight of N,N,N',N'-tetrakis(3-methylphenyl)-3,3'-diaminobenzidine represented by the formula (HT-1):

(HT-1)

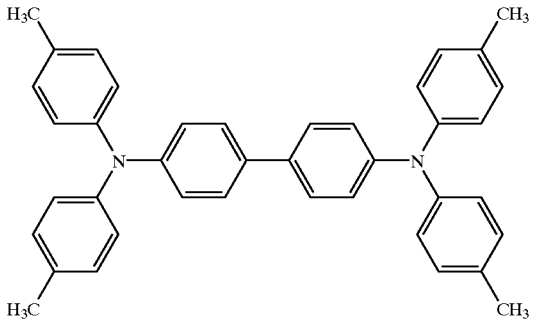

as the hole transferring agent, and 30 parts by weight of the quinone derivative (1-8) as the electron transferring material were mixed and dispersed using a ball mill for 50 hours to prepare a coating solution for single-layer type photosensitive material. Then, a conductive substrate (alumina sheet) was coated with the above coating solution, followed by hot-air drying at 100° C. for 60 minutes to produce a single-layer type electrophotosensitive material having a photosensitive layer of 20 $\mu$m in film thickness.

Example 2

In the same manner as in Example 1, except that 3 parts by weight of 2,6-t-butylbenzoquinone represented by the formula (E-1)

(E-1)

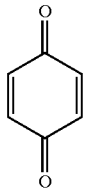

was added as the electron acceptor to prepare a coating solution for single-layer type photosensitive material, a single-layer type electrophotosensitive material was produced.

Example 3

In the same manner as in Example 1, except that 3 parts by weight of 3,5-dimethyl-3',5'-di-t-butyl-4,4'-diphenoquinone represented by the formula (E-2):

(E-2)

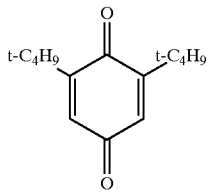

was added as the electron acceptor to prepare a coating solution for single-layer type photosensitive material, a single-layer type electrophotosensitive material was produced.

Example 4

In the same manner as in Example 1, except that 3 parts by weight of 3,5-dimethyl-3',5'-di-t-butyl-4,4'-diphenoquinone represented by the formula (E-3):

(E-3)

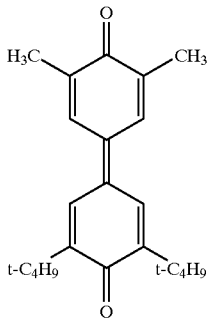

was added as the electron acceptor to prepare a coating solution for single-layer type photosensitive material, a single-layer type electrophotosensitive material was produced.

Example 5

In the same manner as in Example 1, except that 3 parts by weight of 3,3',5,5'-tetra-t-butyl-4,4'-diphenoquinone represented by the formula (E-4):

(E-4)

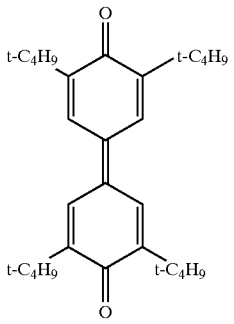

was added as the electron acceptor to prepare a coating solution for single-layer type photosensitive material, a single-layer type electrophotosensitive material was produced.

Examples 6 to 10

In the same manner as in the respective Examples 1 to 5, except that the quinone derivative (2-2) in place of the quinone derivative (1-8) was used, single-layer type electrophotosensitive materials were produced, respectively.

Comparative Examples 1 to 5

In the same manner as in the respective Examples 1 to 5, except that 2,6-di-t-butylbenzoquinone represented by the above-described formula (E-2) in place of the quinone derivative (1-8) was used as the electron transferring material, single-layer type electrophotosensitive materials were produced, respectively.

Comparative Examples 6 to 10

In the same manner as in the respective Examples 1 to 5, except that 2-phenyl-1,4-naphthoquinone represented by the formula (E-5):

(E-5)

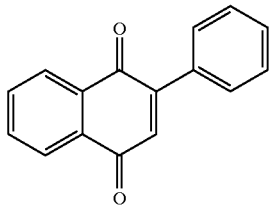

in place of the quinone derivative (1-8) was used as the electron transferring material, single-layer type electrophotosensitive materials were produced, respectively.

Evaluation Test-1

Using a drum sensitivity tester (manufactured by GENTEC Co.), a voltage was applied on the surface of each photosensitive material to charge the surface at +700±20 V and an initial surface potential $V_0$(V) was measured. Then, monochromic light having a wavelength of 780 nm (half-width: 20 nm, light intensity I: 16 $\mu$W/cm$^2$) from white light of a halogen lamp as an exposure light source through a band-pass filter was irradiated on the surface of each photosensitive material (irradiation time: 80 mseconds) and a surface potential at the time at which 330mseconds have passed since the beginning of exposure was measured as a residual potential $V_r$ (unit: V). The measurement results are shown in Table 1.

TABLE 1

| | E.T.M | E.A. | Residual Potential Vr (V) |
|---|---|---|---|
| Example 1 | 1-8 | No | 150 |
| Example 2 | | E-1 | 130 |
| Example 3 | | E-2 | 135 |
| Example 4 | | E-3 | 135 |
| Example 5 | | E-4 | 130 |
| Example 6 | 2-2 | No | 135 |
| Example 7 | | E-1 | 130 |
| Example 8 | | E-2 | 135 |
| Example 9 | | E-3 | 130 |
| Example 10 | | E-4 | 125 |
| Co.Example 1 | E-2 | No | 310 |
| Co.Example 2 | | E-1 | 305 |
| Co.Example 3 | | E-2 | 295 |
| Co.Example 4 | | E-3 | 280 |
| Co.Example 5 | | E-4 | 290 |

TABLE 1-continued

| | E.T.M | E.A. | Residual Potential Vr (V) |
|---|---|---|---|
| Co.Example 6 | E-5 | No | 305 |
| Co.Example 7 | | E-1 | 295 |
| Co.Example 8 | | E-2 | 290 |
| Co.Example 9 | | E-3 | 290 |
| Co.Example 10 | | E-4 | 285 |

E.T.M.; Electron Transferring Material
E.A.; Electron Acceptor

The results show that residual potentials are about 300 V in Comparative Examples 1 to 10, while residual potentials are 125 to 150 V in Examples 1–10 which are much lower than those of Comparative Examples.

Example 11

Hundred parts by weight of an X type metal-free phthalocyanine (CG-1) as the electric charge generating material, 100 parts by weight of polyvinylbutyral as the binder resin and 2000 parts by weight of tetrahydrofuran were mixed and dispersed using a ball mill for 50 hours to prepare a coating solution for electric generating layer. Then, a conductive substrate (alumina sheet) was coated with the resulted coating solution by a wire bar, followed by hot-air drying at 100° C. for 60 minutes to form an electric generating layer having film thickness of 1 $\mu$m.

Then, 100 parts by weight of the quinone derivative (1-8) as the electron transferring material and 100 parts by weight of polycarbonate as the binder resin were mixed and dispersed together with 800 parts by weight of toluene using a ball mill for 50 hours to prepare a coating solution for electric transferring layer. Then, the coating solution was coated on the above electric generating layer by a wire bar, followed by hot-air drying at 100° C. for 60 minutes to form an electric transferring layer having film thickness of 20 $\mu$m produce. Thus, a multi-layer type photosensitive material was produced.

Example 12

In the same manner as in Example 11, except that the quinone derivative (2-2) in place of the quinone derivative (1-8) was used as the electron transferring material, a multi-layer type electrophotosensitive material was produced.

Comparative Example 11

In the same manner as in Example 11, except that 2,6-di-t-butylbenzoquinone represented by the above-described formula (E-2) in place of the quinone derivative (1-8) was used as the electron transferring material, a multi-layer type electrophotosensitive material was produced.

Comparative Example 12

In the same manner as in Example 11, except that 2-phenyl-1,4-naphthoquinone represented by the above-described formula (E-5) in place of the quinone derivative (1-8) was used as the electron transferring material, a multi-layer type electrophotosensitive material was produced.

Evaluation Test-2

In the same manner as Evaluation test-1, residual potentials Vr (V) of multi-layer type electrophotosensitive materials obtained by Examples 11 and 12 and Comparative Examples 11 and 12 were measured. The results are shown in Table 2.

TABLE 2

| | E.T.M. | Residual Potential Vr (V) |
|---|---|---|
| Example 11 | 1-8 | 245 |
| Example 12 | 2-2 | 230 |
| Co.Example 11 | E-2 | 400 |
| Co.Example 12 | E-5 | 410 |

The results show that residual potentials are about 400 V in Comparative Examples 11 and 12, while residual potentials are 245 V to 230 V in Examples 11 and 12 which are much lower than those of the Comparative Examples.

What is claimed is:

1. An electrophotosensitive material comprising a conductive substrate and a photosensitive layer formed on the conductive substrate, the photosensitive layer containing a quinone derivative represented by the general formula (1):

(1)

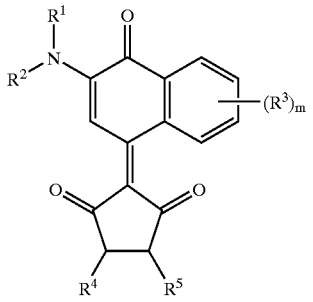

wherein $R^1$ and $R^2$ are the same or different and represent an alkyl group, $R^3$ represents an alkyl group, an alkoxy group, an aryl group, an aralkyl group, a hydrogen atom or a halogen atom, $R^4$ and $R^5$ are the same or different and represent an alkyl group, an alkoxy group, an aryl group, an aralkyl group, a hydrogen atom or a halogen atom, or form a ring by bonding each other, and m represents an integer of 1 to 4, and/or, a quinone derivative represented by the general formula (2):

(2)

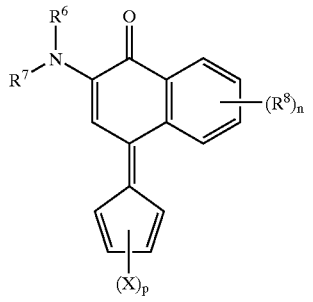

wherein $R^6$ and $R^7$ are the same or different and represent an alkyl group, $R^8$ represents an alkyl group, an alkoxy group, an aryl group, an aralkyl group, a hydrogen atom or a halogen atom, X represents a halogen atom, and n and p represent an integer of 1 to 4.

2. The electrophotosensitive material according to claim 1, wherein said photosensitive layer contains an electron acceptor.

3. The electrophotosensitive material according to claim 1, wherein said photosensitive layer is a single layer constituent containing a binder resin, an electric charge generating material and a quinone derivative represented by the general formula (1) and/or a quinone derivative represented by the general formula (2) as an electron transferring material.

4. The electrophotosensitive material according to claim 1, wherein said photosensitive layer is a multi layer photosensitive material comprising an electric charge generating layer containing an electric charge generating material and an electric charge transferring layer containing a binder resin and the quinone derivative represented by the general formula (1) and/or the quinone derivative represented by the general formula (2) as an electron transferring material.

5. The electrophotosensitive material according to claim 1, wherein the alkyl groups of $R^1$ to $R^8$ have 1 to 6 carbon atoms, the alkoxy groups of $R^3$, $R^4$, $R^5$ and $R^8$ have 1 to 6 carbon atoms, the aryl groups of $R^3$, $R^4$, $R^5$ and $R^8$ have 6 to 14 carbon atoms and the aralkyl groups of $R^3$, $R^4$, $R^5$ and $R^8$ have 6 to 14 carbon atoms.

6. The electrophotosensitive material according to claim 1, wherein the quinone derivative represented by the general formula (1) is one or more compounds selected from the group consisting of (1-1)

The compound of the formula (1-1):

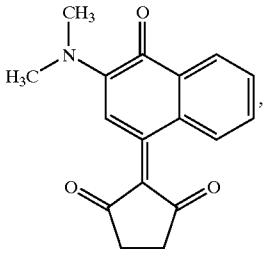

(1-2)

The compound of the formula (1-2):

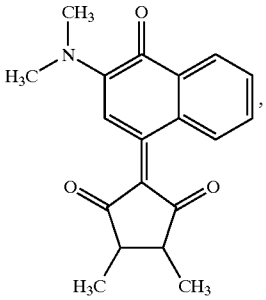

(1-3)

The compound of the formula (1-3):

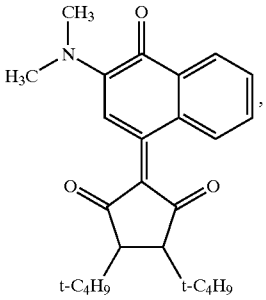

-continued (1-4)

The compound of the formula (1-4):

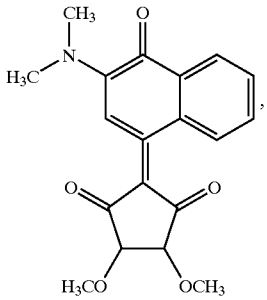

(1-5)

The compound of the formula (1-5):

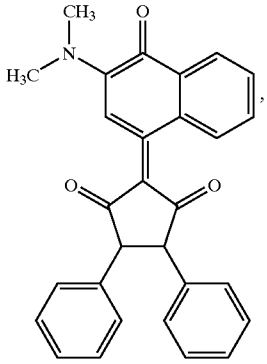

(1-6)

The compound of the formula (1-6):

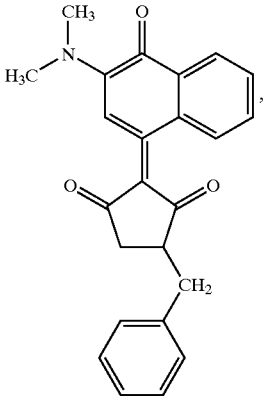

(1-7)

The compound of the formula (1-7):

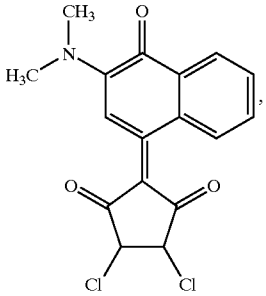

-continued
(1-8)
The compound of the formula (1-8):
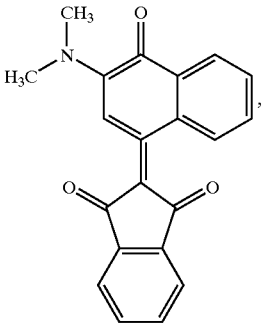
(1-9)
The compound of the formula (1-9):
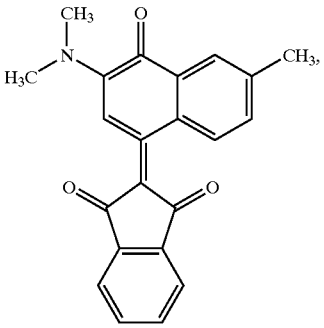
(1-10)
The compound of the formula (1-10):
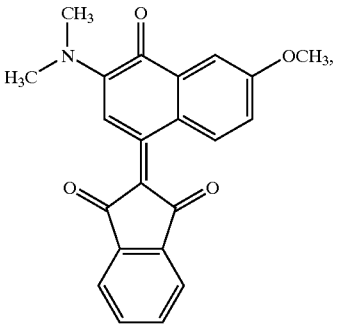
(1-11)
The compound of the formula (1-11):
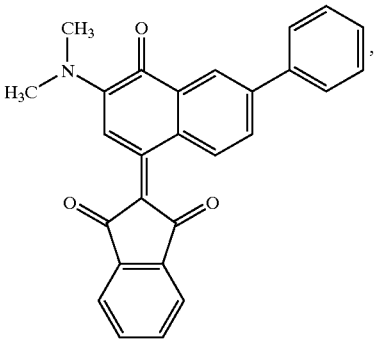
-continued
(1-12)
The compound of the formula (1-12):
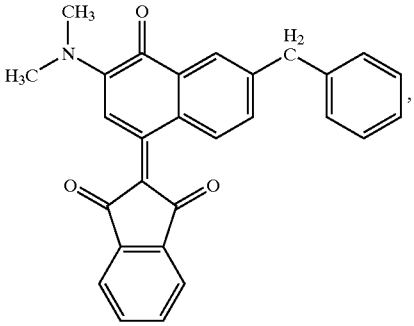
(1-13)
The compound of the formula (1-13):
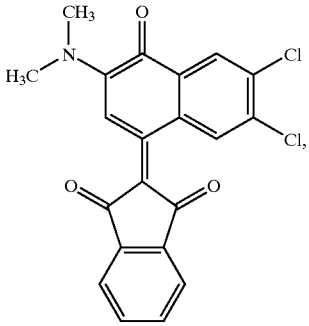
(1-14)
The compound of the formula (1-14):
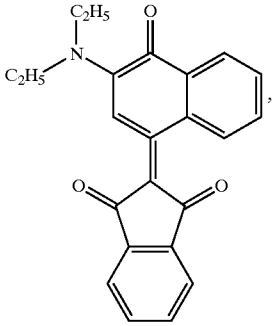
(1-15)
The compound of the formula (1-15):
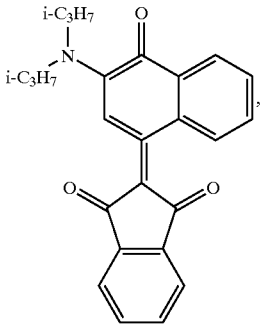

-continued (1-16)

The compound of the formula (1-16):

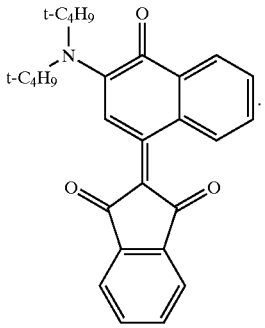

7. The electrophotosensitive material according to claim 1, wherein the quinone derivative represented by the general formula (2) is one or more compounds selected from the group consisting of (2-1)

The compound of the formula (2-1):

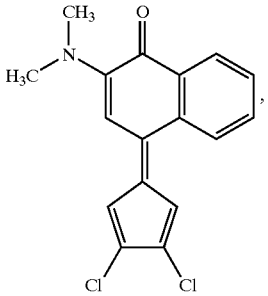

(2-2)

The compound of the formula (2-2):

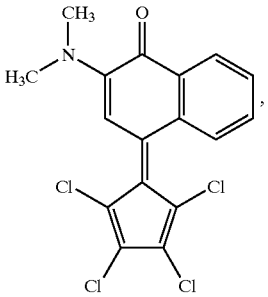

(2-3)

The compound of the formula (2-3):

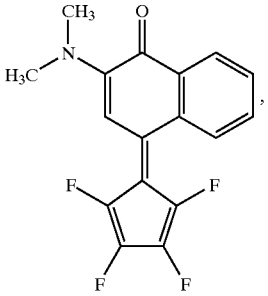

-continued (2-4)

The compound of the formula (2-4):

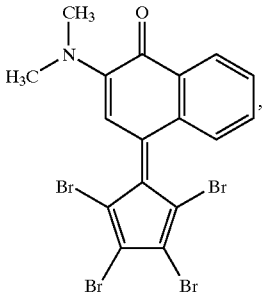

(2-5)

The compound of the formula (2-5):

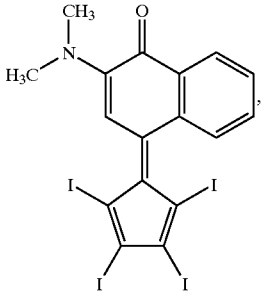

(2-6)

The compound of the formula (2-6):

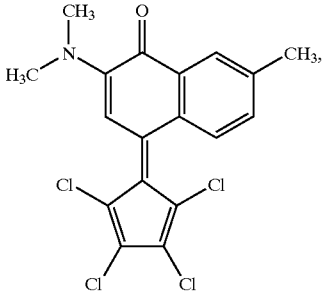

(2-7)

The compound of the formula (2-7):

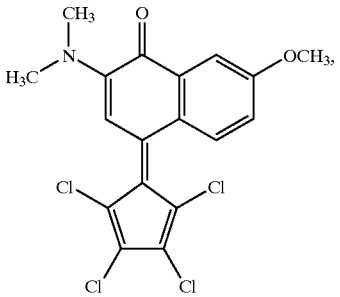

(2-8)

The compound of the formula (2-8):

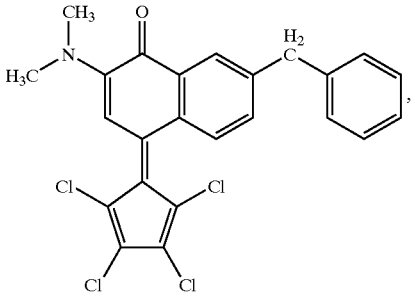

-continued
(2-9)
The compound of the formula (2-9):
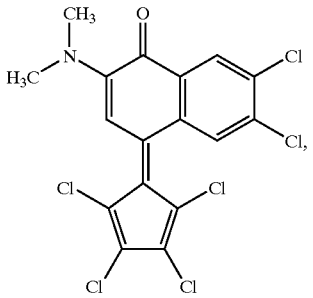
(2-10)
The compound of the formula (2-10):
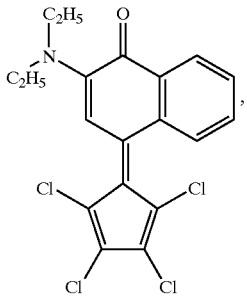
-continued
(2-11)
The compound of the formula (2-11):
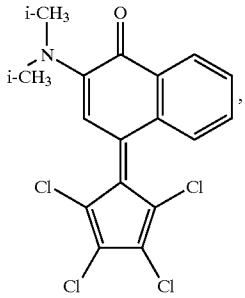
(2-12)
The compound of the formula (2-12):
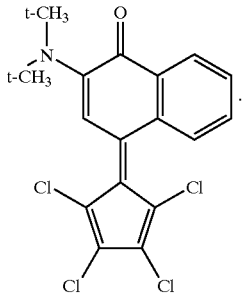
* * * * *